US005230282A

United States Patent [19]

Barnes

[11] Patent Number: 5,230,282

[45] Date of Patent: Jul. 27, 1993

[54] GARBAGE PACKAGING SYSTEM

[76] Inventor: David G. Barnes, 58 Mondragon Circle, Brampton, Ontario, Canada, L6Z 1Z4

[21] Appl. No.: 692,541

[22] Filed: Apr. 29, 1991

[51] Int. Cl.[5] ..... B65B 13/18

[52] U.S. Cl. ..... 100/34; 53/390; 100/912; 211/50; 211/181; 211/106; 242/141; 242/146

[58] Field of Search ..... 100/1, 34, 8, 912; 53/390, 592; 211/45, 49.1, 50, 106, 118, 119, 181, 195; 242/146, 141, 170, 171

[56] References Cited

U.S. PATENT DOCUMENTS

| | | | |
|---|---|---|---|
| 262,556 | 8/1882 | Bailey | 211/106 |
| 446,691 | 2/1891 | Nottingham | 242/141 |
| 634,908 | 10/1899 | Perry | 211/106 |
| 882,245 | 3/1908 | Gibson | 242/146 |
| 892,174 | 6/1908 | Mayer | 242/146 |
| 969,069 | 8/1910 | Lippincott | 100/34 X |
| 1,422,659 | 7/1922 | Bulman | 211/181 X |
| 2,972,416 | 2/1961 | De Vivo | 211/50 |
| 3,255,939 | 12/1965 | Braun | 211/181 X |
| 4,238,035 | 12/1980 | Kassanchuk | 211/181 X |
| 4,694,966 | 9/1987 | Sorenson et al. | 211/181 X |

FOREIGN PATENT DOCUMENTS

| | | | |
|---|---|---|---|
| 3413300 | 10/1985 | Fed. Rep. of Germany | 100/34 |
| 41421 | 1/1933 | France | 100/34 |
| 335983 | 10/1930 | United Kingdom | 100/34 |
| 728328 | 4/1955 | United Kingdom | 100/34 |

*Primary Examiner*—Stephen F. Gerrity

[57] ABSTRACT

A packaging system comprises a rack for bundable material and a twine dispenser. The rack has a transverse slot open at one end through which twine may depend from the twine dispenser for tying in a loop around the bundable material without the necesscity of lifting or disturbing the material in the rack.

5 Claims, 5 Drawing Sheets

GARBAGE PACKAGING SYSTEM

FIELD OF THE INVENTION

This invention relates to a packaging system for bundlable material such as paper and/or board.

BACKGROUND OF THE INVENTION

It has been the practice in various countries by various public authorities to make a provision for garbage collection of paper products separately from other garbage collections. Moreover, in industrial and commercial environments the disposal of cardboard boxes and other old wrapping materials has presented a considerable problem. It has been the practice to bind paper and board of all varieties into parcels using twine or tape. These parcels are then put out for garbage disposal. Alternatively, paper and board garbage of all types has been crammed into cardboard boxes which are themselves put out for disposal.

With the recent emphasis on recycling, considerable pressure has been put on the domestic and industrial consumer to separate garbage not only into paper and general garbage, but into different types of paper. Thus, it is frequently found unacceptable to present newspaper for recycling in a cardboard container. The consumer is often required to parcel newspaper alone, using twine. These rather stringent methods have been counter-productive and that the packaging or parcelling has itself been at least a nuisance. In order to parcel newspapers, the consumer must assemble a reasonably large, tidy bundle and lift it in order to locate the twine around its lower surface. Flattened cardboard boxes may be even more unwieldy than newspaper bundles. Moreover, storage of the newspaper and cardboard prior to parcelling and tying with twine may not always be convenient.

SUMMARY OF THE INVENTION

An attempt has been made to provide a packaging system for domestic or commercial use for bundling paper products. According to the invention, a packaging system for bundlable material comprises a rack having a plurality of tongues supportable above the ground and arranged in side-by-side relationship with a slot therebetween, and a twine dispenser associated with the or each slot, the or each dispenser being locatable above the rack and having means to direct twine emerging therefrom to depend vertically through the slot.

The tongues may be connected together on one side of the rack and in which the slot being open to an opposing side of the rack, so that a depending length of twine depends through the slot to be located behind garbage later placed in the rack. The tongues may be connected together by an upstanding wall or, when the rack is formed of plastic coated rigid wire, by an upstanding framework.

The tongues may include holding means for material placed thereon. For example, the holding means may be provided by inclining the tongues upwardly from said one side to form a trough. The tongues may be either from the bottom of the rack or from a forwardly extending ledge of the rack which may allow for greater capacity in the trough. When a forwardly extending ledge is present, the tongues may upstand vertically so that the trough has a substantially U-section. The slot may or may not extend through the ledge.

In one embodiment the twine dispenser is formed of a plurality of panels hinged one to another so that the twine dispenser may be opened out, flat, or folded flat or have some panels bent upwardly to form the assembled cage.

In use, the rack may be attached to a vertical surface such as a wall. Conveniently, the wall, in a domestic environment, might be a kitchen wall, and, in a commercial environment, it may be a warehouse or restaurant wall, or even the wall of a supermarket in the customer location or in the warehouse location. The size of the tongues of the device may vary according to the type of material to be collected in it. Thus, when newspapers are to be collected, the length of the rack over the length of the side-by-side tongues with a slot between them may conveniently be somewhere in the region of two feet to accommodate the length of the newspapers. Where the rack is to accommodate larger items such as flattened cardboard cartons, it may be made longer. Moreover, while it is envisaged that the device will normally comprise a pair of tongues with a single slot between them for use with a single length of twine, there is no reason why it should not comprise more than two tongues aligned over the length of the rack with slots between adjacent tongues. In this case, a twine dispenser will be available for each slot.

When assembled for use, the twine dispenser will be located above the rack so that twine dispensed from the dispenser will fall through the slot associated with it. As garbage accumulates in the environment, the consumer may place the paper product garbage in the tongue so that the twine falls through the slot behind the garbage. Thus, when the rack is mounted on the wall, the twine will fall between the garbage and the wall. Conveniently, the twine dispenser will also be mounted on the wall above the slot so that the twine depends through the slot towards the rear of the rack. When the tongue is full or when the consumer judges that a sufficient paper product is present to form a suitably sized parcel, an end of the twine may be retrieved from beneath the rack and tied directly around the paper product garbage through the slot.

BRIEF DESCRIPTION OF THE DRAWINGS

Embodiments of the invention will now be described by way of example with reference to the accompanying drawings in which

FIGS. 1, 2 and 3 of the drawings show one embodiment of the invention while FIGS. 4 and 5 show slightly different embodiments and FIG. 6 shows an unfolded twine dispenser. Where similar parts of the system are common to all the embodiments, similar reference numbers will be used for these parts. Differences between the embodiments will be referred to.

DESCRIPTION OF THE PREFERRED EMBODIMENTS

Figure 1:
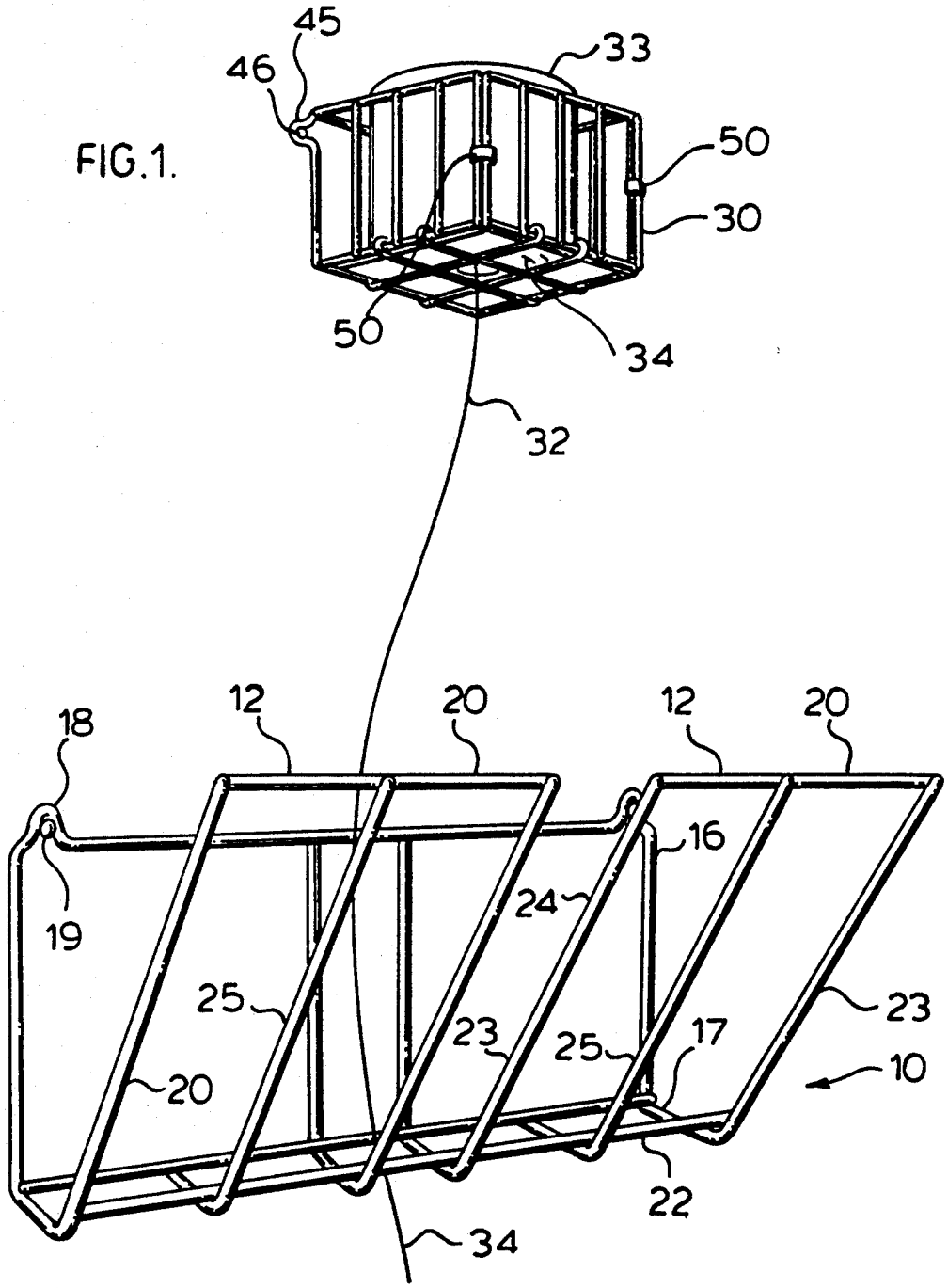
FIG. 1 shows an embodiment of the invention comprising two tongues and a single twine dispenser.
Figure 2:
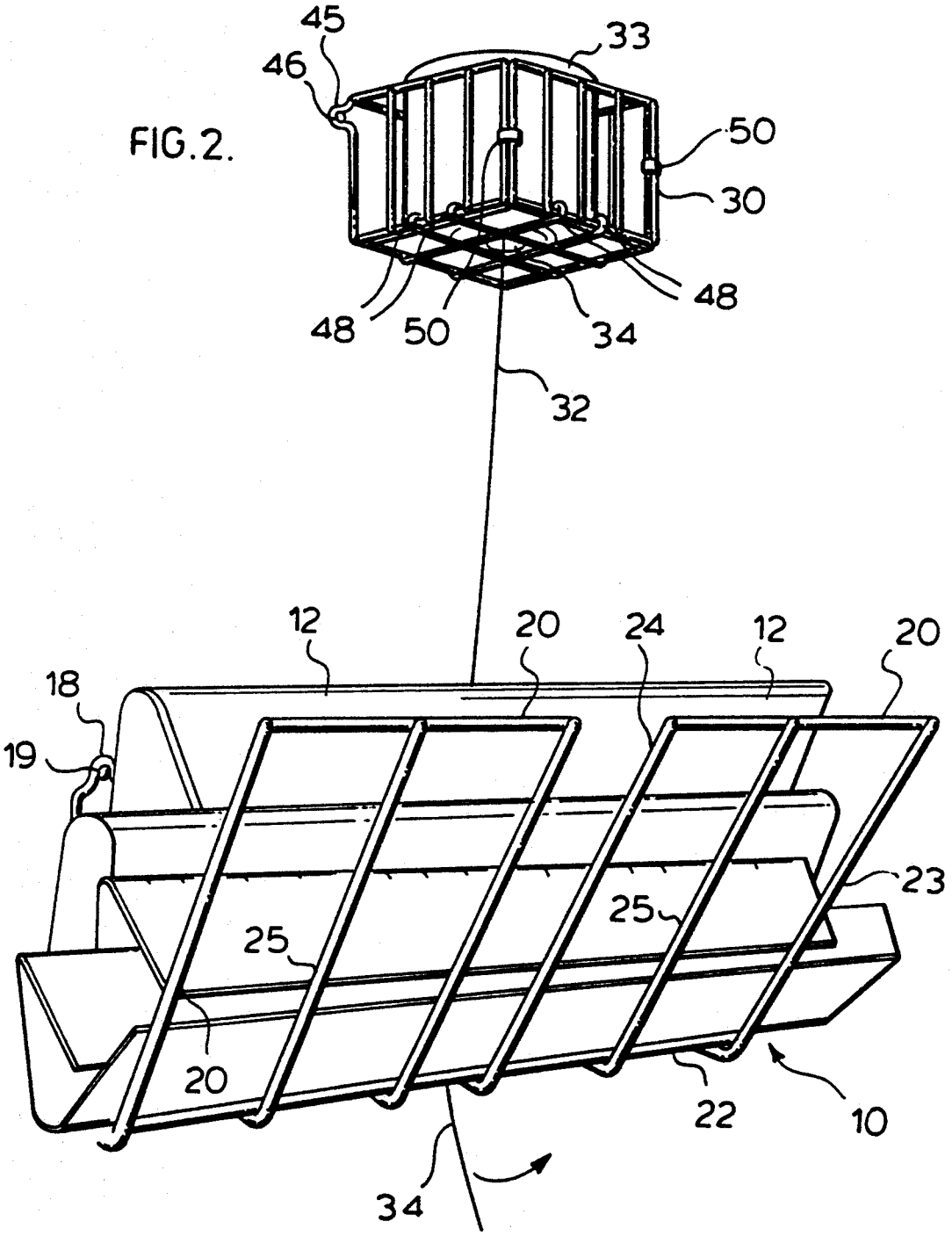
FIG. 2 shows the packaging system of FIG. 1 with garbage collected therein.
Figure 3:
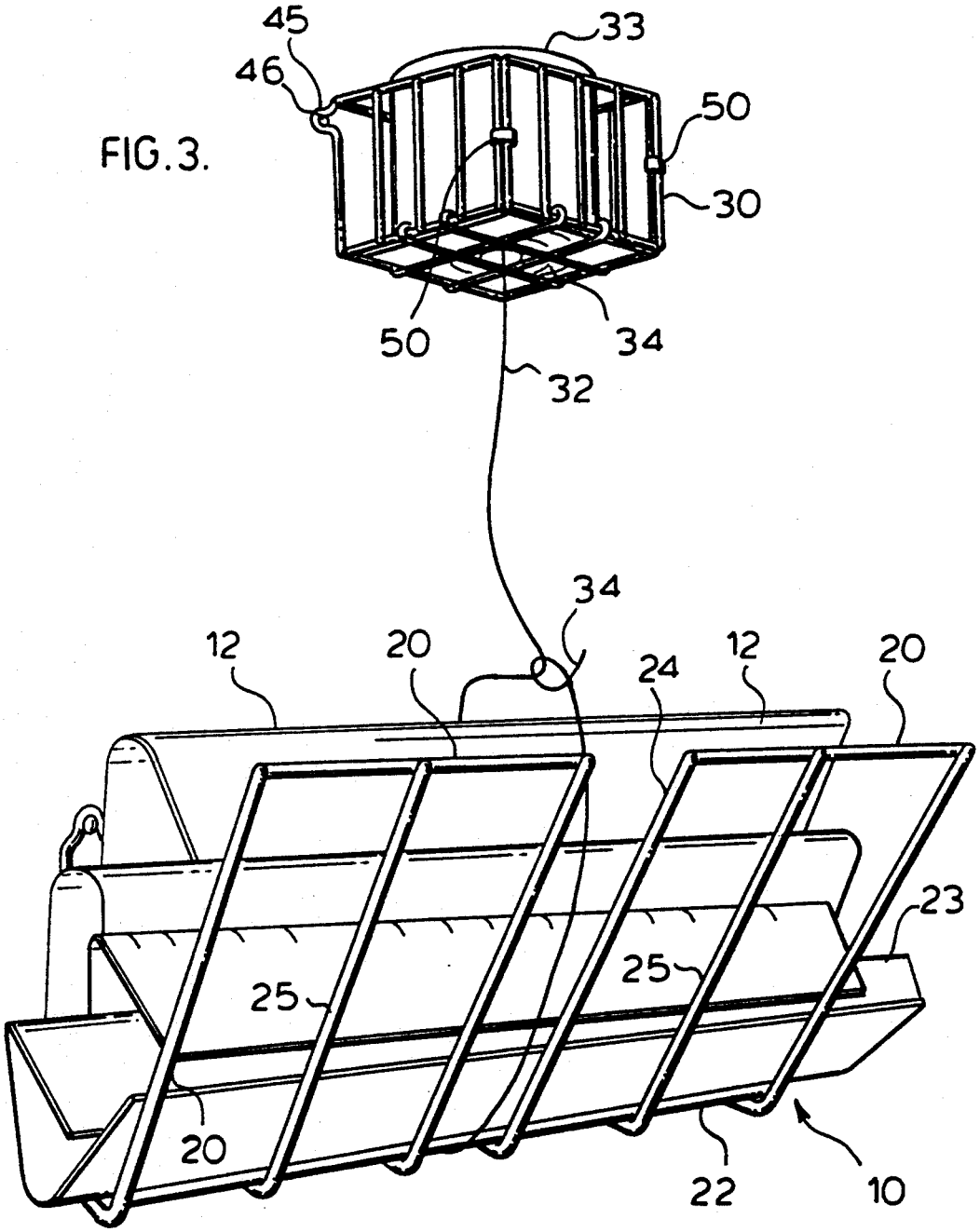
FIG. 3 shows the manner of wrapping the twine around the garbage in the system of FIG. 2.
Figure 4:
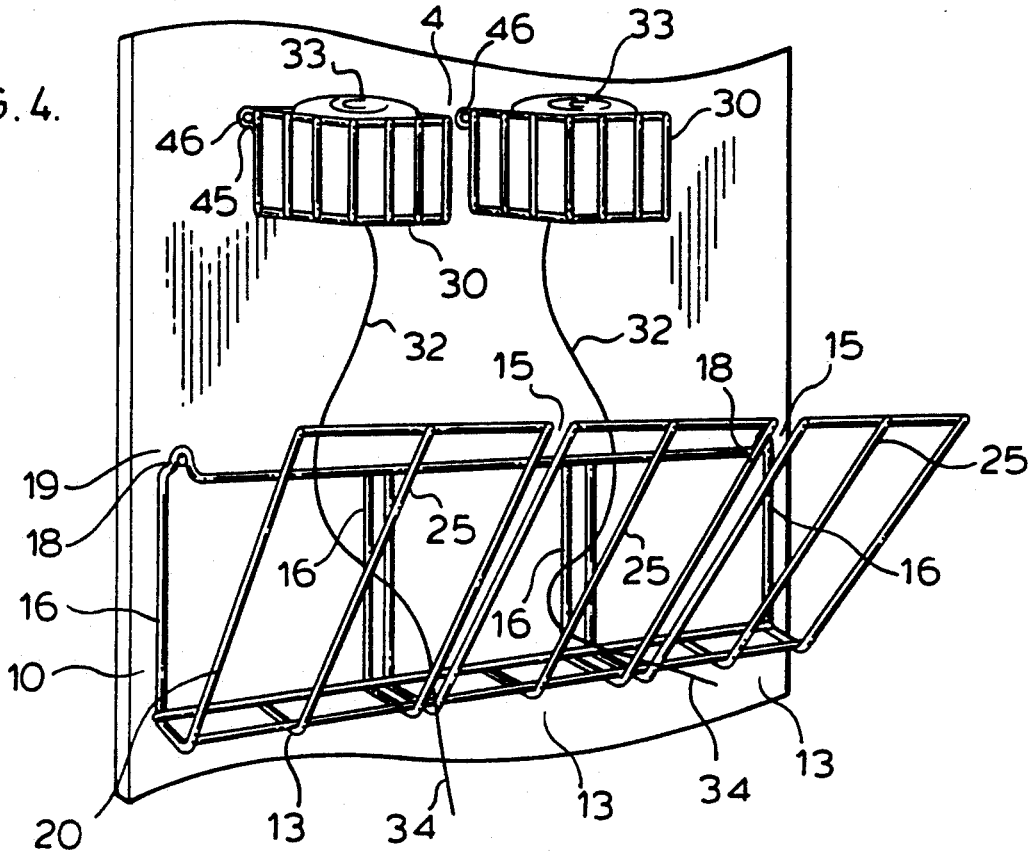
FIG. 4 shows a different embodiment of the packaging system.
Figure 5:
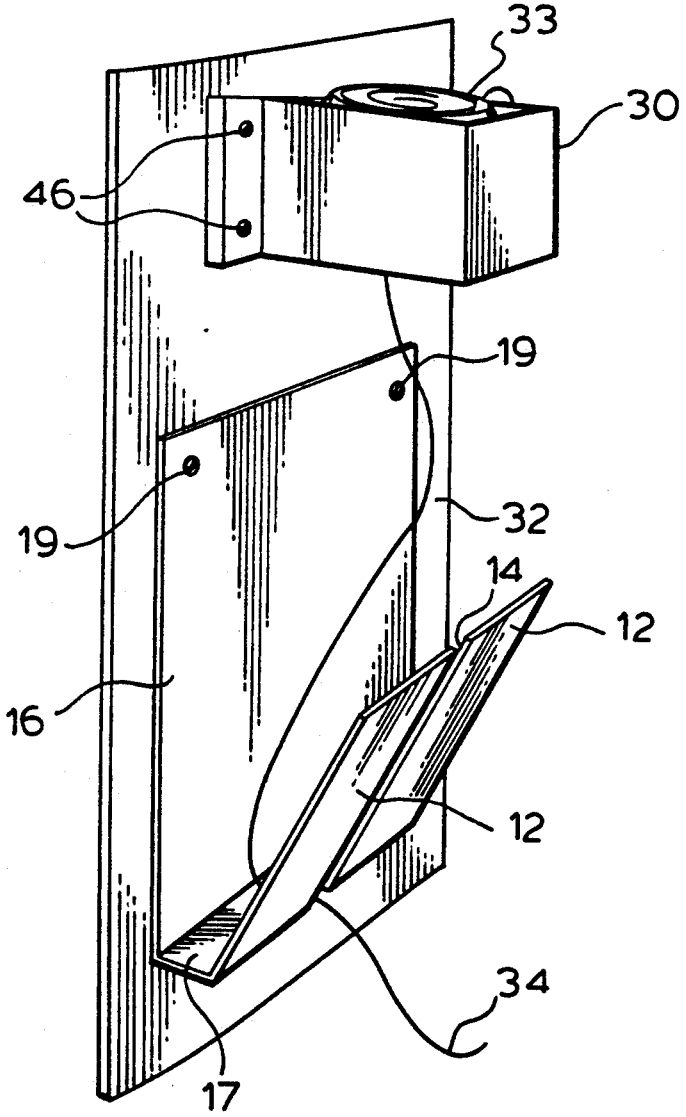
FIG. 5 shows another embodiment of the packaging system.

A packaging system, as shown in FIGS. 1, 2 and 3, comprises a rack 10 itself comprising a pair of tongue 12 having a slot 14 therebetween. This rack is formed from plastic coated rigid wire as shown in FIGS. 1, 2 and 3 and also in the different embodiments of FIG. 4. However, as can be seen from FIG. 5, it may equally as well be formed from sheet material which, for commercial use, heavy-duty use may be stainless steel of suitable gauge. Alternatively, other sheet materials which may be formed to shape may be used. For some very lightweight domestic uses, it may be possible to mold the rack from plastic material. The following description will be generally directed to the rack form of plastic coated wire construction, but it will be understood that the parts of the rack could equally as well be made in another form, for example, sheet.

To the rear of the rack is an upstanding barrier 16 connecting the tongues together. This barrier 16 rises vertically from the tongues and is provided with hooks or half-moon 18 to latch with securing screws 19 for attaching the rack to a wall. When the barrier 16 is sheet material, then holes may be provided in it for the screws. Since the barrier 16 is intended to lie flush with a wall, it is vertical and, when plastic coated wire construction is used, it may be of very open work construction. However, it will be understood that the rack 10 may be free-standing in which case the barrier 16 may be angled outwardly and will be provided with vertical and/or cross members or netting so that material placed in the tongue do not fall through the barrier.

The tongue 12 extends forwardly to either side of slot 14 from the base of barrier 16. Suitably, a forwardly extending shelf 17 may be provided to widen the trough formed between the tongues. The shelf may be relatively narrow as shown so that the trough is nearly V-shaped between the barriers 16 and tongues 12, or it may be wide so that the trough is U-shaped. When the trough is U-shaped the tongues may extend vertically. The slot 14 may or may not extend through the ledge 17 when present, the tongue. The tongue may then rise slantwise or (vertically when ledge 17 is present) to provide retaining means to inhibit the spillage of paper or cardboard garbage forwardly from the tongues 12.

Normally, a pair of tongues will be sufficient and the tongues need not extend over the whole length of the garbage which is to be collected. Thus, if newspaper is to be collected of a general length dimension of around two feet, the side-by-side tongues and the slot may have a combined length corresponding with this measurement, i.e., about two feet. However, it is probably sufficient for the length of the rack to be about one foot so that the paper extends from the rack at its end. The dimensions are really a matter of choice and larger racks will be necessary for larger-sized garbage. When very elongate garbage is to be collected, it may be desirable to use a rack having more than two tongues as, for example, the rack 11 of FIG. 4 which has three tongues 13 with slots 15 between them.

When a rack has a length dimension of around one foot and is to be utilized for the collection of newspaper, it may be sufficient that a tongue may be formed of plastic coated, rigid wire comprising only a base wire 20, a top wire 22 and two opposing side wires 23 and 24. However, to inhibit the paper falling through the tongues, it is at least desirable to include further members such as wire 25 dividing a tongue from front to back and from top to bottom. It is, of course, possible to make the tongues from wire shelving in which the parallel wires are regularly spaced at close intervals of, for example, an inch or less.

It may be an additional feature of the invention that the tongues may be hingable to the base of the rack so that it may be opened into a condition for the collection of garbage as shown in any of the drawings or closed flat when not in use or for packing.

The width of the slot need not be wide but made at least sufficient to allow the twine to pass through.

The twine dispenser 30 may be located above the rack 10 so that twine 32 depending from it may fall through the slot 14. The twine dispenser 30 is conveniently made of plastic coated rigid wire having an open work space 34 through which the twine 32 may depend. If the dispenser 30 is made with solid walls, i.e., as a box of wood, plastic or metal, it may be provided with an orifice in its lower surface through which the twine may be threaded to depend from the dispenser. The top of the dispenser 30 may be opened or, if desired, may be provided with a lid (not shown). If, for some reason, it is inconvenient to arrange the dispenser directly above the tongue so that the twine depends through the slot 14 or through one of the slots 15, it is possible to provide guide means to lead the twine through the slot. However, in this instance, it is desirable that the lower part of the twine above the rack immediately adjacent the paper or board garbage packaging should be vertically arranged. A knife edge or serrated edge may be provided at a suitable location on the dispenser for cutting the twine.

The twine, itself, may be a ball or reel 33 of twine or any other suitable package from which twine may be withdrawn and it may be loosely placed in the twine dispenser and threaded through the orifice or through the open lattice work of the plastic coated rigid wire base to depend through the respective slot 14, 15 of a rack 10. Alternatively, the twine may be provided in a card or other box, itself provided with a dispensing hole for the twine. In this case, the box may be provided with a serrated or other cutting edge. Moreover, in this case the dispenser need not be a cage but may merely be a shelf for the box of twine. The base of the twine dispenser may be square mesh plastic coated rigid wire. The twine may pass through one mesh, thus being confined to depend in a limited frame. The side panels, while shown slotted, may equally well be meshed. Suitably, the twine is pulpable twine compatible with the pulp characteristics of the paper or board garbage being collected.

The end 34 of the twine depending through the slot 14, 15 to dangle freely below it may, when the level of garbage in the rack has reached a suitable level for parcelling, it can pulled upwards by the consumer in the direction of the arrow shown in FIG. 2 to form a bight of twine around the paper or board garbage. Since the twine 32 passes through the open slot 14, 15, the base of the tongues 12 will not impede direct contact of the twine with the paper, thus the lower end 33 of the twine 32 may be tied to the run of twine depending from the twine dispenser 30 to parcel the paper or board without any need to lift the paper or board or disturb their position in the rack 10. It is important that the depending run of twine 32, when the rack is a wall-fixed rack, should pass behind the paper or board in the rack. In practice, this will occur automatically since the consumer will place the paper or board garbage in the rack from the front thus biasing the twine towards the wall. It is unlikely that, without a special effort, the consumer would slot the paper or board garbage between the string and the wall so that the string fell forwardly of the garbage. However, it is convenient to make provision for depending the twine towards the rear of the rack to enhance the natural tendency for it to be trapped between the paper and the upstanding rear connecting member of the rack.

When the twine dispenser 30 is formed from plastic coated wire and has a lattice work face, it is very easy to thread the twine through the base at a point near the wall and depend it through the slot 14, 15 towards the rear of the rack. When the dispenser 30 is formed with solid walls, it is usually sufficiently small that any orifice for the twine will allow the twine to be dispensed to fall towards the rear of the rack but, if desired, a dispensing orifice may be formed to the rear of the base of the twine dispenser rather than centrally or in another position.

Figure 6:
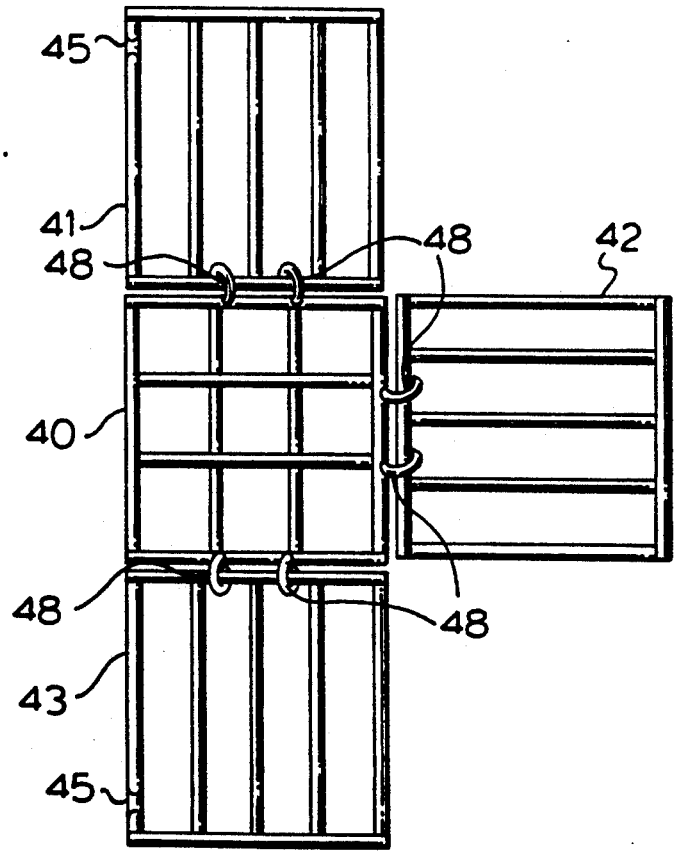
FIG. 6 shows an embodiment of the twine dispenser in unfolded form.

The dispenser may be made of one piece construction (see FIG. 4) or, for packing purposes or for storage or for folding away when not in use, the twine dispenser may be made of panels hinged one to another so that it folds flat. Conveniently, five panels may be used when the dispenser is to be wall-mounted. Such a 5-panel arrangement is shown in FIG. 6. A square mesh panel 40 may form the base and barred panels 41, 42 and 43 may be hinged to it to form three sides at hinges 48. The wall to which the dispenser is to be mounted effectively forms the fourth side. When the dispenser is not to be wall-mounted, an additional panel may be provided. For storage or packing, the panels may be shown in the condition of FIG. 6 or may be folded flat one above the other. In use, panels 41, 42 and 43 are angled upwardly at 90° to the base panel 40 and are connected together by any convenient form of clips or catches 50.

The system is used in the following manner.

The rack 10 is fixed to a vertical wall surface by securing screws 19 in half-moon hooks and the dispenser 30 is attached to the wall above the rack by screws 46 in half-moon hooks 45. Of course, other fixing means may be used such as screws and washers extending over bars of the rack or twine dispenser. A ball or roll of twine, preferably pulpable twine, is placed in the dispenser and a length of twine is depended from the dispenser close to the wall through slot 14 so that its free end 33 falls below the rack. The system is now ready for collection of paper or board garbage. This garbage is then collected in the dispenser until the pile is considered large enough for parcelling. At that point, the free end 33 of the twine is pulled forward and upwardly over the pile of garbage and is tied to the depending length of twine 32. A single band of tied twine is normally sufficient but, as previously commented, if very long lengths of garbage are to be collected, a rack such as that shown in FIG. 4, may be used having more than one slot. In this case also, it will be necessary to use two twine dispensers 30, one arranged over each slot. The parcelled paper is lifted from the rack and removed for disposal. It will be seen that the twine parcels the paper directly without the need for disturbing the paper from the base of the rack. After the parcel has been removed from the rack, more twine can be pulled from the twine dispenser so that the operation may be repeated.

It will be clear that various modifications and improvements are possible within the scope of the invention. For example, the twine dispenser might suitably be replaced by a taper dispenser. More than one turn of tape or twine may be taken around the garbage once the initial turn of twine has unified the garbage into an initial package. Other bundlable materials, possibly cloth fragments or twigs or other garden garbage may be bundled in a similar manner.

The embodiments of the invention in which an exclusive property or privilege is claimed are defined as follows:

1. A packaging system for paper or cardboard comprising:

a rack formed of plastic coated rigid wire; the rack having a first side having a top end and a bottom end and an opposing side having a top end and a bottom end; the first side and the opposing side formed as a plurality of tongues arranged in side-by-side relationship with a slot therebetween at the opposing side; the tongues being connected together at the first side of the rack; the first side of the rack being provided with means for securement of the rack to a vertical wall; the opposing side inclining upwardly and forwardly from the bottom end thereof and away from the top end of the first side whereby a trough is formed in the rack by the first side and the opposing side for holding paper or cardboard; and a twine dispenser formed of plastic coated, rigid wire as a cage for twine; the dispenser being locatable above the rack and having a slot therethrough to direct twine to depend vertically downward from the twine dispenser toward and through the slot in the rack whereby paper or cardboard may be placed into the rack trough and atop the twine in the slot in the rack to permit packaging of the paper or cardboard by the twine; the twine dispenser further having means for securement to the vertical wall above the rack.

2. A packaging system as claimed in claim 1 wherein said plurality of tongues comprises a pair of tongues.

3. A packaging system as claimed in claim 1 in which the twine dispenser is formed of a plurality of panels connected one to another.

4. A packaging system as claimed in claim 3 in which the panels are hinged one to another for folding flat, opening flat and for location at angles to one another.

5. A packaging system as claimed in claim 1 wherein the first side and the opposing side are interconnected at the bottom ends thereof by a base; and the rack trough being formed by the first side, the base and the opposing side.

* * * * *